US008919465B2

(12) United States Patent
Takeo

(10) Patent No.: US 8,919,465 B2
(45) Date of Patent: Dec. 30, 2014

(54) CONSTRUCTION MACHINE

(75) Inventor: Jitsutaka Takeo, Chiba (JP)

(73) Assignee: Sumitomo (S.H.I.) Construction Machinery Co., Ltd., Tokyo (JP)

( * ) Notice: Subject to any disclaimer, the term of this patent is extended or adjusted under 35 U.S.C. 154(b) by 77 days.

(21) Appl. No.: 13/514,407

(22) PCT Filed: Dec. 8, 2010

(86) PCT No.: PCT/JP2010/072043

§ 371 (c)(1),
(2), (4) Date: Aug. 8, 2012

(87) PCT Pub. No.: WO2011/071084

PCT Pub. Date: Jun. 16, 2011

(65) Prior Publication Data

US 2012/0325568 A1 Dec. 27, 2012

(30) Foreign Application Priority Data

Dec. 8, 2009 (JP) ..... P2009-278599

(51) Int. Cl.

| | |
|---|---|
| ***B66C 13/12*** | (2006.01) |
| ***E02F 9/24*** | (2006.01) |
| ***B66C 1/08*** | (2006.01) |
| ***E02F 9/08*** | (2006.01) |
| ***E02F 9/20*** | (2006.01) |

(52) U.S. Cl.

CPC ... *E02F 9/24* (2013.01); *B66C 1/08* (2013.01); *E02F 9/0833* (2013.01); *E02F 9/0858* (2013.01); *E02F 9/2025* (2013.01)

USPC ..... 180/65.21

(58) Field of Classification Search

CPC ..... B66C 1/08; E02F 9/0858; E02F 9/2025

USPC ..... 180/65.245, 65.285, 65.275, 65.21; 903/903

See application file for complete search history.

(56) References Cited

U.S. PATENT DOCUMENTS 6,476,571 B1 * 11/2002 Sasaki ..... 318/139
8,037,963 B2 * 10/2011 Nishimura et al. ..... 180/291

(Continued)

FOREIGN PATENT DOCUMENTS

JP 2000-45329 A 2/2000
JP 2003096820 A 4/2003

(Continued)

OTHER PUBLICATIONS

JP Office Action for JP Application No. P2009-278599, dated Mar. 12, 2013.

(Continued)

*Primary Examiner* — J. Allen Shriver, II
*Assistant Examiner* — Brian Cassidy
(74) *Attorney, Agent, or Firm* — Squire Patton Boggs (US) LLP

(57) ABSTRACT

A construction machine with improved safety can include a high voltage cable for supplying power. The high voltage cable connects a storage devices to an electric drive that drives using power from a power generation device, which generates power using the drive of an engine, or from the storage device, which stores the power generated by the power generation device, is wired along the sides of a frame structural member that protrudes in a vertical direction. The frame structural member serves as an upright wall to adequately protect the high voltage cable. In cases in which, for example, the construction machine strikes an obstruction, or the like, the high voltage cable is adequately protected by the frame structural member.

2 Claims, 16 Drawing Sheets

(56) References Cited

U.S. PATENT DOCUMENTS

| | | | | |
|---|---|---|---|---|
| 8,198,836 | B2 * | 6/2012 | Kachi et al. | 318/139 |
| 8,335,603 | B2 * | 12/2012 | Mitsutani et al. | 701/22 |
| 8,662,969 | B2 * | 3/2014 | Shimomura et al. | 454/141 |
| 2010/0065356 | A1 * | 3/2010 | Reddy et al. | 180/65.31 |
| 2010/0256851 | A1 * | 10/2010 | Mitsutani | 701/22 |
| 2010/0263953 | A1 * | 10/2010 | Shimana | 180/65.285 |
| 2012/0256481 | A1 * | 10/2012 | Maurer | 307/10.1 |

FOREIGN PATENT DOCUMENTS

| | | | |
|---|---|---|---|
| JP | 2003312274 | A | 11/2003 |
| JP | 2004-68292 | A | 3/2004 |
| JP | 2004-169466 | A | 6/2004 |
| JP | 2004328870 | A | 11/2004 |
| JP | 2005-68962 | A | 3/2005 |
| JP | 2007-205120 | A | 8/2007 |
| WO | 2008-015798 | A1 | 2/2008 |

OTHER PUBLICATIONS

PCT/JP2010/072043 International Search Report Mailed Mar. 22, 2011.

PCT/JP2010/072043 International Preliminary Report on Patentability Mailed Jul. 19, 2012.

* cited by examiner

CONSTRUCTION MACHINE

TECHNICAL FIELD

The present invention relates to a construction machine.

BACKGROUND ART

In the past, there has been proposed a so-called hybrid construction machine that generates power by the drive of an engine, stores the generated power in an electrical storage device, and assists the drive of the engine using the stored power. For example, a generator, an electrical storage device, and an inverter, which controls charge and power supply between these, are closely disposed in a centralized configuration in a construction machine disclosed in the following PTL 1, so that the lengths of wires connecting electrical devices are short.

CITATION LIST

Patent Literature

[PTL 1] JP-A-2004-169466

SUMMARY OF INVENTION

Technical Problem

However, actually, there is a case where the respective electrical devices cannot be closely disposed in a centralized configuration. For this reason, it is hoped that wires for connecting electrical devices, which cannot be closely disposed in a centralized configuration as described above, can be safely disposed.

Accordingly, an object of the invention is to provide a construction machine where the safety of wires is improved.

Solution to Problem

A construction machine of the invention includes an engine, power generation means for generating power by the drive of the engine, storage means for storing the power generated by the power generation means, and electric drive means that is driven by the power from the storage means. High voltage cables, which connect the power generation means or the electric drive means to the storage means and through which power is supplied, are wired along a side surface of a frame structural member that protrudes in a vertical direction.

According to the construction machine of the invention, since the high voltage cables are wired along the side surface of the frame structural member protruding in the vertical direction, the frame structural member becomes an upright wall, so that the high voltage cables are adequately protected. Accordingly, for example, even when the construction machine collides with an obstruction or the like, the high voltage cables are adequately protected by the frame structural member. As a result, safety is improved.

Here, the high voltage cables, which are wired along the side surface of the frame structural member, may be specifically high voltage cables between the power generation means and an inverter that is connected to the storage means and controls the power generation means or high voltage cables between the electric drive means and an inverter that is connected to the storage means and controls the electric drive means.

Further, the frame structural member may be an A-frame that supports a boom for work so as to allow the boom for work to be capable of moving up and down, and the high voltage cables may be wired along an inner side surface of the A-frame. When this structure is employed, the high voltage cables are adequately protected by the A-frame having high rigidity, so that it is possible to improve safety. In addition, for example, even when the construction machine collides with an obstruction or the like, the A-frame is separated from a collision portion since it is disposed at a central portion. Accordingly, the high voltage cables are more adequately protected.

Moreover, the frame structural member may be a side frame that forms an end portion of a base frame and forms a closed cross-sectional space, and the high voltage cables may be wired so as to pass through the side frame. Since the high voltage cables pass through the side frame that has high rigidity and forms a closed cross-section when this structure is employed, the high voltage cables are adequately protected, so that safety can be improved. Further, since the side frame surrounding the high voltage cables blocks electromagnetic waves as described above, electromagnetic shielding performance can be improved.

Advantageous Effects of Invention

According to the construction machine of the invention, it is possible to adequately protect high voltage cables and to improve safety.

DESCRIPTION OF EMBODIMENTS

Figure 1:
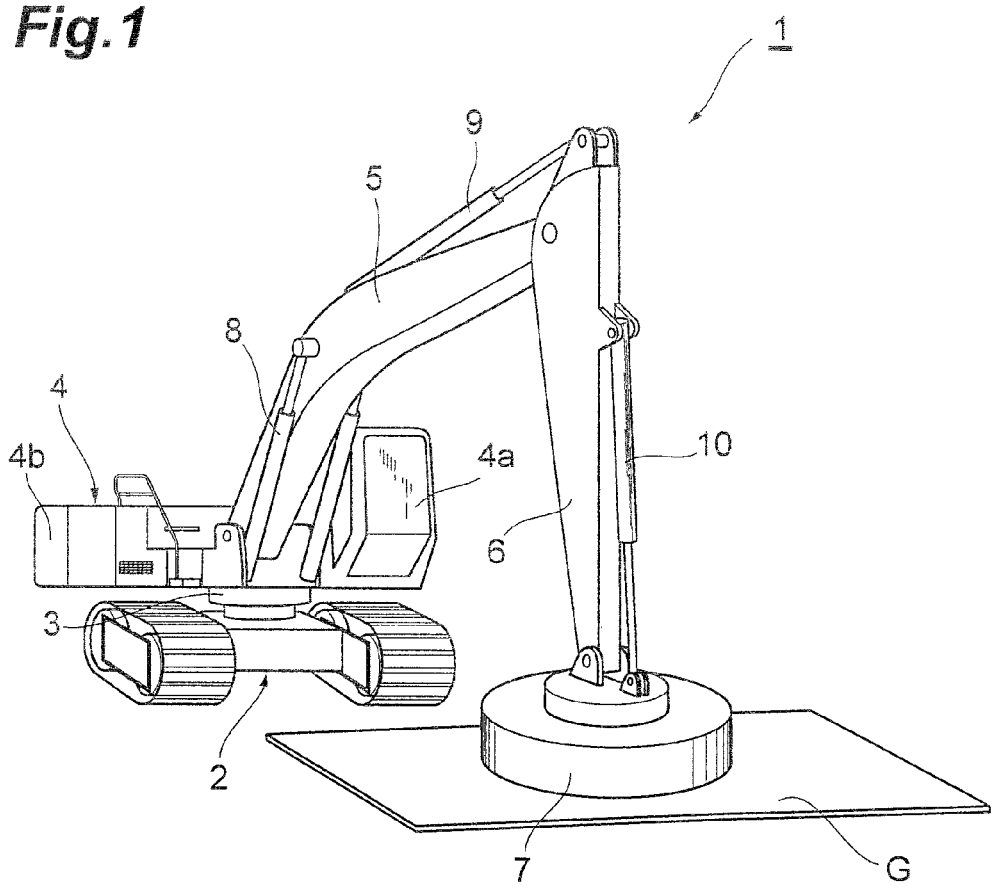
FIG. 1 is a perspective view showing the appearance of a construction machine according to a first embodiment of the invention.

Preferred embodiments of a construction machine according to the invention will be described below with reference to the drawings. Meanwhile, the same elements in the description of the drawings are denoted by the same reference numerals, and repeated description thereof will be omitted.

FIG. 1 is a perspective view showing the appearance of a construction machine according to a first embodiment of the invention. The construction machine of this embodiment is a so-called hybrid construction machine, and a lifting magnet vehicle as an example of the construction machine is shown.

As shown in FIG. 1, a lifting magnet vehicle 1 includes a traveling mechanism 2 that includes caterpillar tracks and a revolving body 4 that is rotatably mounted on the traveling mechanism 2 with a revolving mechanism 3 interposed therebetween. A boom 5 for work, an arm 6 link-connected to an end of the boom 5, and a lifting magnet 7 link-connected to an end of the arm 6 are mounted on the revolving body 4. The lifting magnet 7 is apiece of equipment that attracts a load G such as steel material by a magnetic force so as to catch the load. The boom 5, the arm 6, and the lifting magnet 7 are hydraulically driven by a boom cylinder 8, an arm cylinder 9, and a bucket cylinder 10, respectively.

Further, the revolving body 4 is provided with an operator's cab 4*a* and a house portion 4*b*. The operator's cab 4*a* accommodates an operator who adjusts the position of the lifting magnet 7 and performs an exitation operation and a release operation of the lifting magnet. The house portion 4*b* accommodates a power source, that is, an engine 11 (see FIG. 2) that is a power source for generating hydraulic pressure, and the like. The engine 11 is formed of, for example, a diesel engine.

Figure 2:
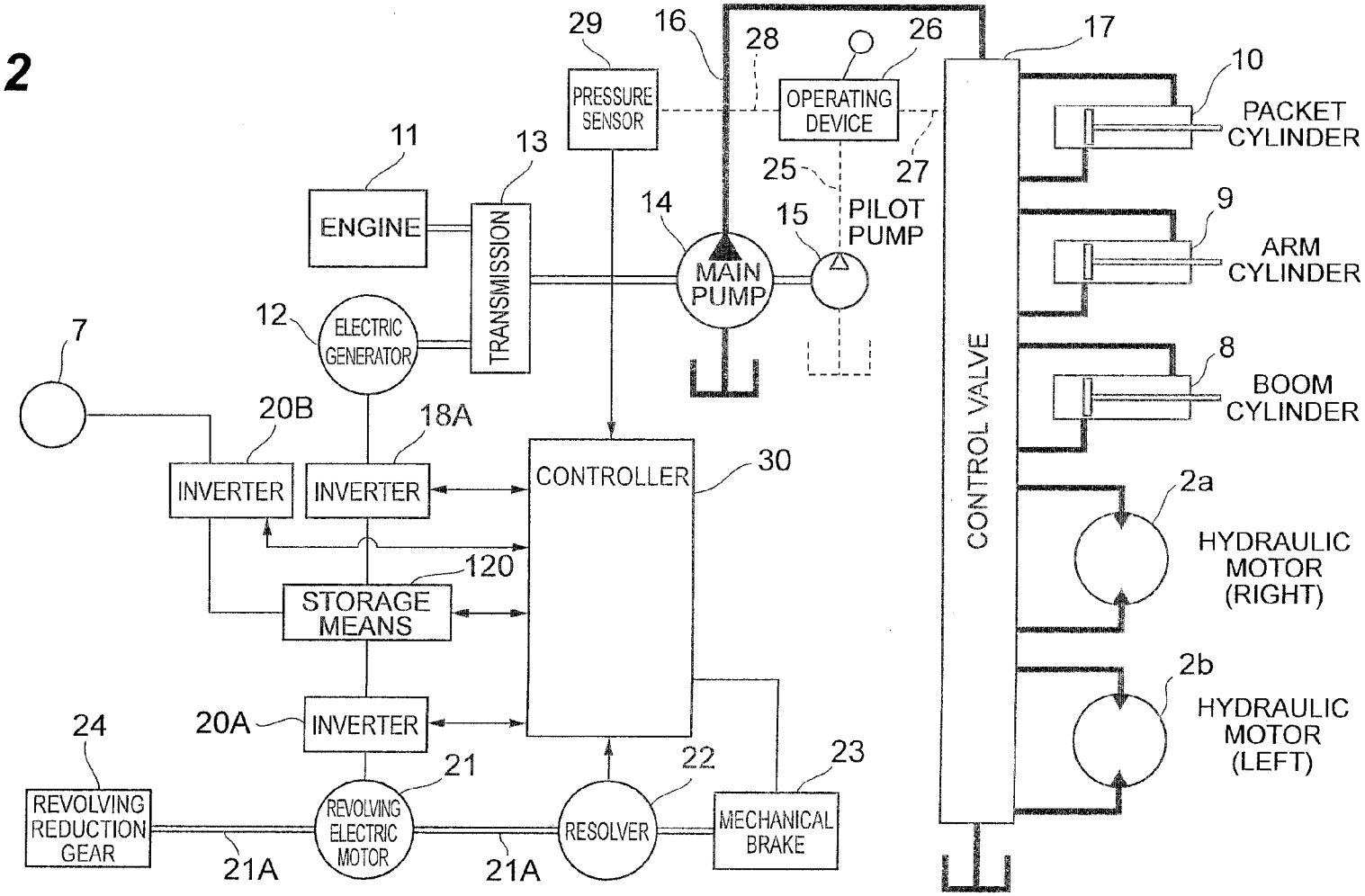
FIG. 2 is a block diagram showing the internal structure of an electrical system, a hydraulic system, and the like of the construction machine shown in FIG. 1.
Figure 3:
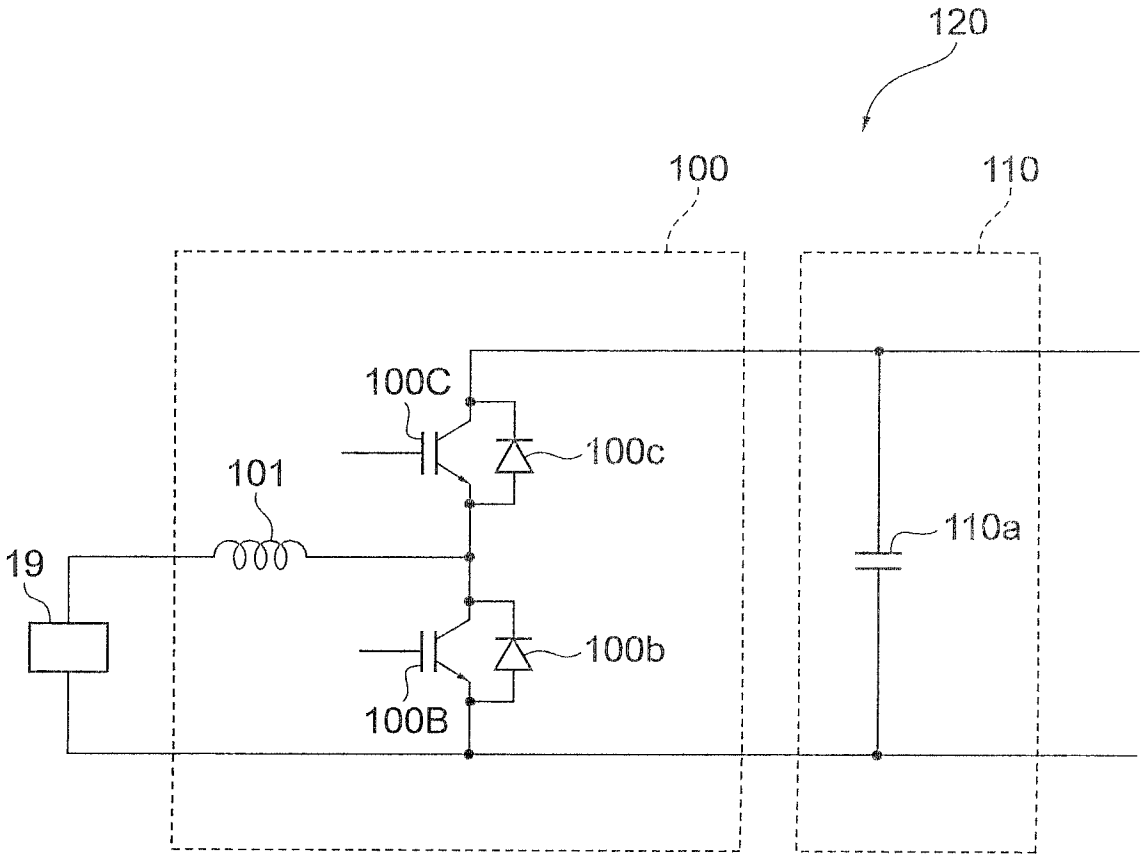
FIG. 3 is a circuit diagram showing the internal structure of storage means shown in FIG. 2.

FIG. 2 is a block diagram showing the internal structure of an electrical system, a hydraulic system, and the like of the construction machine shown in FIG. 1, and the structure is a so-called parallel type. Meanwhile, in FIG. 2, systems mechanically transmitting power are shown by double lines, a hydraulic system is shown by a thick solid line, a control system is shown by a broken line, and an electrical system is shown by a thin solid line. Further, FIG. 3 is a diagram showing the internal structure of storage means 120 shown in FIG. 2.

As shown in FIG. 2, the lifting magnet vehicle 1 includes an electric generator (power generation means) 12 and a transmission 13, and rotating shafts of the engine 11 and the electric generator 12 are connected together to an input shaft of the transmission 13, so that the engine 11 and the electric generator 12 are connected to each other. When a load of the engine 11 is large, the electric generator 12 assists the driving force of the engine 11 by driving the engine 11 as a work element and the driving force of the electric generator 12 is transmitted to a main pump 14 through an output shaft of the transmission 13. Meanwhile, when the load of the engine 11 is small, the driving force of the engine 11 is transmitted to the electric generator 12 through the transmission 13. Accordingly, the electric generator 12 generates power.

The electric generator 12 is formed of, for example, an IPM (Interior Permanent Magnetic) motor where magnets are embedded in a rotor. Switching between the drive and power generation of the electric generator 12 is performed by a controller 30, which controls the drive of the electrical system of the lifting magnet vehicle 1, according to the load of the engine 11 and the like.

The main pump 14 and a pilot pump 15 are connected to the output shaft of the transmission 13, and a control valve 17 is connected to the main pump 14 through a high-pressure hydraulic line 16. The control valve 17 is a unit that controls the hydraulic system of the lifting magnet vehicle 1. In addition to left and right hydraulic motors 2*a* and 2*b* that drive the traveling mechanism 2 shown in FIG. 1, the boom cylinder 8, the arm cylinder 9, and the bucket cylinder 10 are connected to the control valve 17 through hydraulic lines, and the control valve 17 controls hydraulic pressure, which is supplied to these cylinders and motors, according to driver's operation input.

An output end of an inverter circuit (inverter) 18A is connected to an electrical terminal of the electric generator 12. The storage means 120 is connected to an input end of the inverter circuit 18A. As shown in FIG. 3, the storage means 120 includes a DC bus 110 that is a DC bus bar, a step-up/down converter 100, and a capacitor 19. That is, an input end of the inverter circuit 18A is connected to an input end of the step-up/down converter 100 through the DC bus 110. The capacitor 19 is connected to an output end of the step-up/down converter 100. Here, the capacitor 19 includes a plurality of cells. Meanwhile, a battery may be used instead of the capacitor.

Returning to FIG. 2, the inverter circuit 18A controls the operation of the electric generator 12 on the basis of an instruction from the controller 30. That is, when electrically operating (assisting) the electric generator 12, the inverter circuit 18A supplies required power to the electric generator 12 from the capacitor 19 and the step-up/down converter 100 through the DC bus 110. Further, when the electric generator 12 is operated so as to generate power, power generated by the electric generator 12 is stored in the capacitor 19 through the DC bus 110 and the step-up/down converter 100. Meanwhile, switching between the step-up operation and step-down operation of the step-up/down converter 100 is controlled by the controller 30 on the basis of a voltage value of the DC bus, a voltage value of the capacitor, and a current value of the capacitor. Accordingly, it is possible to maintain the DC bus 110 in a state where the DC bus is charged at a predetermined constant voltage value.

Furthermore, the lifting magnet 7 shown in FIG. 1 is connected to the DC bus 110 of the storage means 120 through an inverter circuit 20B. The lifting magnet 7 includes an electromagnet that generates a magnetic force for magnetically attracting metal materials, and is supplied with power from the DC bus 110 through the inverter circuit 20B. The inverter circuit 20B supplies required power to the lifting magnet 7 from the DC bus 110 when turning on the electromagnet on the basis of an instruction from the controller 30. Moreover, the inverter circuit 20B supplies regenerated power to the DC bus 110 when turning off the electromagnet.

In addition, an inverter circuit (inverter) 20A is connected to the storage means 120. A revolving electric motor (AC electric motor; electric drive means) 21 as an electric motor for work is connected to one end of the inverter circuit 20A, and the other end of the inverter circuit 20A is connected to the DC bus 110 of the storage means 120. The revolving electric motor 21 is a power source of the revolving mechanism 3 shown in FIG. 1 that revolves the revolving body 4. A resolver 22, a mechanical brake 23, and a revolving reduction gear 24 are connected to a rotating shaft 21A of the revolving electric motor 21.

When the revolving electric motor 21 performs a power running operation, the torque of a rotational driving force of the revolving electric motor 21 is amplified at the revolving reduction gear 24. Accordingly, the acceleration and deceleration of the revolving body 4 are controlled and the revolving body 4 is operated so as to rotate. Further, rotation speed is increased at the revolving reduction gear 24 by the inertial rotation of the revolving body 4 and is transmitted to the revolving electric motor 21, so that the regenerated power is generated. The revolving electric motor 21 is AC-driven according to a PWM (Pulse Width Modulation) control signal by the inverter circuit 20A. For example, a magnet embedded type IPM motor is preferred as the revolving electric motor 21.

The resolver 22 is a sensor that detects the rotational position and the rotation angle of the rotating shaft 21A of the revolving electric motor 21, and detects the rotation angle and the rotating direction of the rotating shaft 21A by being mechanically connected to the revolving electric motor 21. The resolver 22 derives the rotation angle and the rotating direction of the revolving mechanism 3 by detecting the rotation angle of the rotating shaft 21A. The mechanical brake 23 is a braking device that generates a mechanical braking force, and mechanically stops the rotating shaft 21A of the revolving electric motor 21 according to an instruction from the controller 30. The revolving reduction gear 24 is a reduction gear that reduces the rotating speed of the rotating shaft 21A of the revolving electric motor 21 and mechanically transmits the rotating speed to the revolving mechanism 3.

Meanwhile, since the electric generator 12, the revolving electric motor 21, and the lifting magnet 7 are connected to the DC bus 110 through the inverter circuits 18A, 20A, and 20B, the power generated by the electric generator 12 may be directly supplied to the lifting magnet 7 or the revolving electric motor 21, the power regenerated by the lifting magnet 7 may be supplied to the electric generator 12 or the revolving electric motor 21, and the power regenerated by the revolving electric motor 21 may be supplied to the electric generator 12 or the lifting magnet 7.

An operating device 26 is connected to the pilot pump 15 through a pilot line 25. The operating device 26 is an operating device that operates the revolving electric motor 21, the traveling mechanism 2, the boom 5, the arm 6, and the lifting magnet 7. The operating device 26 is operated by an operator. The control valve 17 is connected to the operating device 26 through a hydraulic line 27, and a pressure sensor 29 is connected to the operating device 26 through a hydraulic line 28. The operating device 26 converts hydraulic pressure (primary-side hydraulic pressure), which is supplied through the pilot line 25, into hydraulic pressure (secondary-side hydraulic pressure), which corresponds to the amount of work performed by an operator, and outputs the converted hydraulic pressure. The secondary-side hydraulic pressure, which is output from the operating device 26, is supplied to the control valve 17 through the hydraulic line 27 and is detected by the pressure sensor 29.

When an operation for revolving the revolving mechanism 3 is input to the operating device 26, the pressure sensor 29 detects the amount of operation as the change of hydraulic pressure in the hydraulic line 28. The pressure sensor 29 outputs an electrical signal that represents hydraulic pressure in the hydraulic line 28. This electrical signal is input to the controller 30, and is used to control the drive of the revolving electric motor 21.

The controller 30 forms a control circuit of this embodiment. The controller 30 is formed of a processing unit that includes a CPU and an internal memory. The CPU executes a drive control program stored in the internal memory, so that the controller 30 is realized. Further, a power supply of the controller 30 is a battery (for example, 24V in-vehicle battery) that is separate from the capacitor 19. The controller 30 converts a signal, which represents the amount of operation required for revolving the revolving mechanism 3, among signals input from the pressure sensor 29 into a speed instruction, and controls the drive of the revolving electric motor 21. Further, the controller 30 controls the charge and discharge of the capacitor 19 that is performed by the control of the operation of the electric generator 12 (switching between an assist operation and a power generating operation), the control of the drive of the lifting magnet 7 (switching between excitation and demagnetization), and the control of the drive of the step-up/down converter 100.

Here, the step-up/down converter 100 of this embodiment will be described in detail. As shown in FIG. 3, the step-up/down converter 100 has a step-up/down switching control system, and includes a reactor 101 and transistors 100B and 100C. The transistor 100B is a step-up switching element, and the transistor 100C is a step-down switching element. The transistors 100B and 100C are formed of, for example, IGBTs (Insulated Gate Bipolar Transistors), and are connected in series to each other.

Specifically, a collector of the transistor 100B and an emitter of the transistor 100C are connected to each other, an emitter of the transistor 100B is connected to a negative-side terminal of the capacitor 19 and a negative-side wire of the DC bus 110, and a collector of the transistor 100C is connected to a positive-side wire of the DC bus 110. Further, one end of the reactor 101 is connected to the collector of the transistor 100B and the emitter of the transistor 100C, and the other end of the reactor 101 is connected to a positive-side terminal of the capacitor 19. A PWM voltage is applied to gates of the transistors 100B and 100C from the controller 30.

Meanwhile, a diode 100*b*, which is a rectifying element, is connected in parallel in an opposite direction between the collector and the emitter of the transistor 100B. Likewise, a diode 100*c* is connected in parallel in an opposite direction between the collector and the emitter of the transistor 100C. A smoothing capacitor 110*a* of the DC bus 110 is connected between the collector of the transistor 100C and the emitter of the transistor 100B (that is, between the positive-side wire and the negative-side wire of the DC bus 110). The capacitor 110*a* smoothes a voltage that is output from the step-up/down converter 100, a voltage that is generated from the electric generator 12, and a voltage that is regenerated from the revolving electric motor 21.

In the step-up/down converter 100 having the above-mentioned structure, a PWM voltage is applied to the gate of the transistor 100B according to an instruction from the controller 30 when DC power is supplied to the DC bus 110 from the capacitor 19. Further, an induced electromotive force generated at the reactor 101 is transmitted through the diode 100*c* according to the turning-on/off of the transistor 100B, and this power is smoothed by the capacitor 110*a*. Furthermore, when DC power is supplied to the capacitor 19 from the DC bus 110, a PWM voltage is applied to a gate of the transistor 100C according to an instruction from the controller 30 and current output from the transistor 100C is smoothed by the reactor 101.

Figure 4:
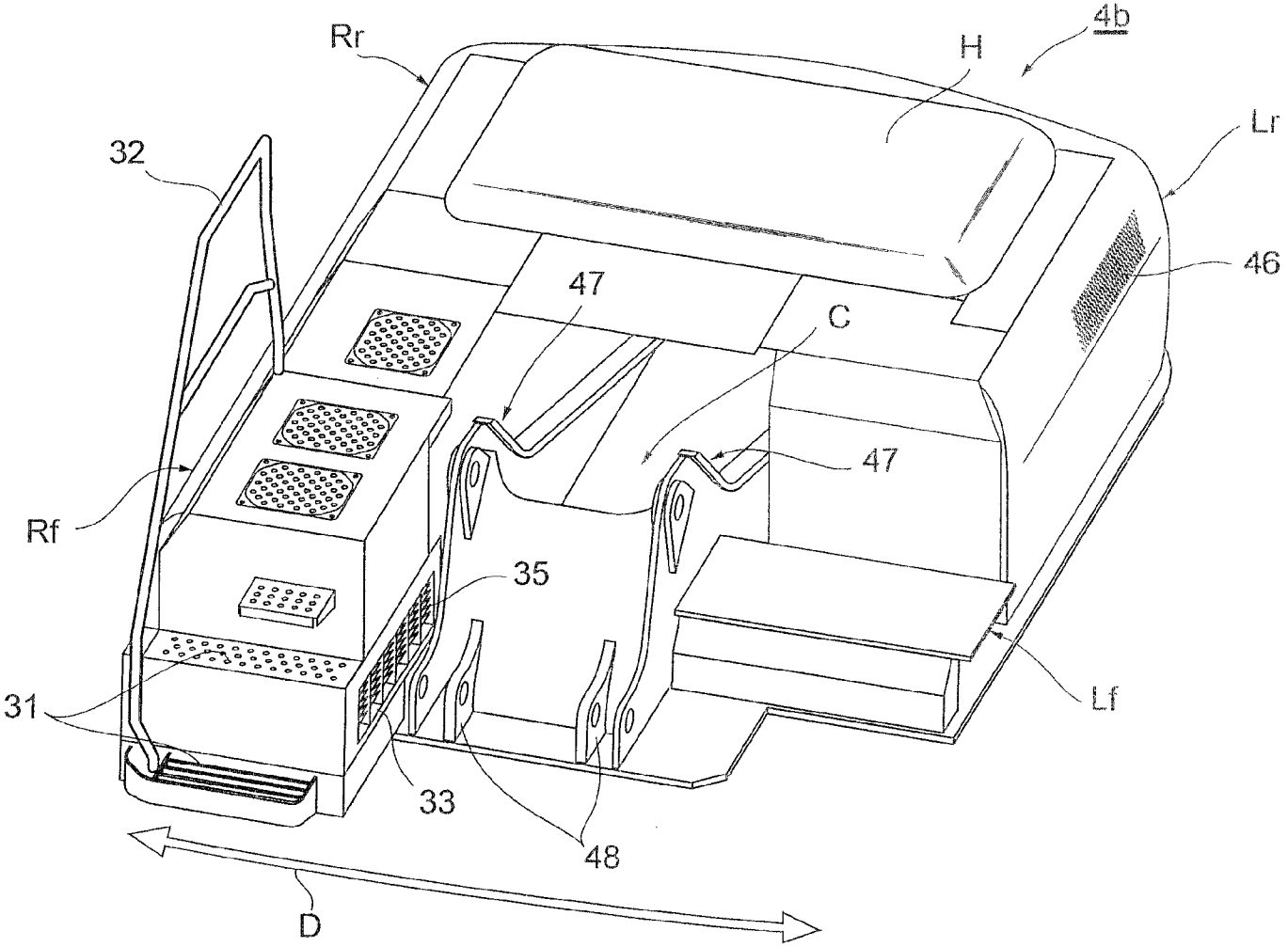
FIG. 4 is a perspective view showing a house portion of a revolving body shown in FIG. 1.

Subsequently, the revolving body 4 will be described. FIG. 4 is a perspective view showing the house portion 4*b* of the revolving body 4. Hereinafter, in the description of the structure of the house portion 4*b*, the front, the rear, the left, and the right means the front, the rear, the left, and the right of the lifting magnet vehicle 1 unless otherwise particularly mentioned. As shown in FIG. 4, the house portion 4*b* is formed so as to have a substantially U-shape in plan view, and is disposed so that an opened portion of the U-shape faces forward. Here, in the house portion 4*b*, a right front portion (a left front portion shown in FIG. 4) of a vehicle is referred to as a right front portion Rf, a right rear portion (a left back portion shown in FIG. 4) is referred to as a right rear portion Rr, a left front portion (a right front portion shown in FIG. 4) is referred to as a left front portion Lf, a left rear portion (a right back portion shown in FIG. 4) is referred to as a left rear portion Lr, and a portion between the right front portion Rf and the left front portion Lf is referred to as a central portion C.

The operator's cab 4*a* shown in FIG. 1 is provided so as to correspond to the left front portion Lf of the house portion 4*b*, and a base end of the boom 5 is mounted on the central portion C so as to be capable of moving up and down. Further, the revolving body 4 including the house portion 4*b* is rotated about an axis extending in a vertical direction, that is, is revolved to left and right in a revolving direction D by the revolving electric motor 21 (see FIG. 2) that is provided below the central portion C. The right front portion Rf is provided with steps 31 for maintenance and a handrail 32.

The storage means 120, the inverter circuits 18A, 20A, and 20B, and the controller 30, which are shown in FIG. 2, are installed in the right front portion Rf. Opening portions are formed at the lower portions of the left and right surfaces of the right front portion Rf, respectively, and the capacitor 19 of the storage means 120 is installed between the right opening portion 34 (see FIG. 5) and the left opening portion 33. That is, the left and right opening portions 34 and 33 are formed as vents through which air for cooling the capacitor 19 flows to the left and right.

Figure 5:
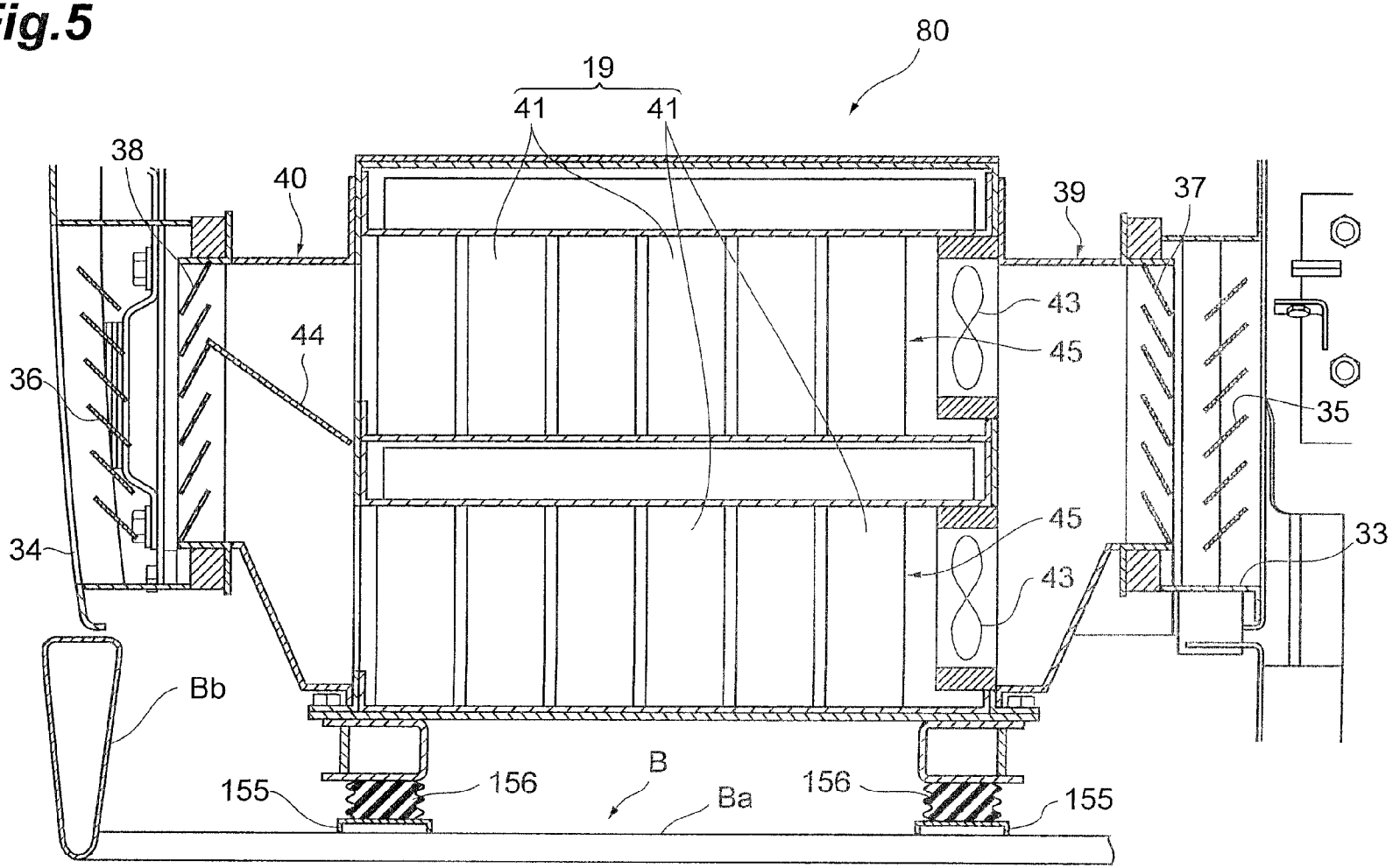
FIG. 5 is a cross-sectional view showing a state where a capacitor box of storage means is installed in the house portion.

FIG. 5 is a cross-sectional view of a capacitor 19 and the like installed in the lower portion of the right front portion Rf as seen from the front side. A base frame B, which includes a bottom frame Ba and an outer peripheral frame Bb, is shown in FIG. 5. The bottom frame Ba is a frame member that forms the bottom of the house portion 4*b*. The outer peripheral frame Bb is erected at the peripheral edge (the left side in FIG. 5) of the bottom frame Ba.

As shown in FIG. 5, louvers 36 and 35 are provided at the right front portion Rf inside the right and left opening portions 34 and 33, respectively. Further, a capacitor box 80 including the capacitor 19 is provided between the louvers 35 and 36, and is installed on the bottom frame Ba with seats 155 and vibration-proof rubbers 156 interposed therebetween. A plurality of cells 41 is arranged side by side on upper and lower stages and assembled, so that the capacitor 19 is formed. The assembly of the cells 41 of the upper stage forms an upper-stage module 45, and the assembly of the cells 41 of the lower stage forms a lower-stage module 45. These modules 45 and 45 are surrounded and reinforced by an outer frame so as to allow air to flow to the left and right, so that the capacitor box 80 is formed.

An air intake duct 40 is connected to the right side (the left side in FIG. 5) of the capacitor box 80, and louvers 38 are provided at the upstream end portion in the air intake duct 40 so as to face the louvers 36. Further, fans 43 and 43, which make cooling air flow to the right from the left in FIG. 5, are provided at the left (right in FIG. 5) end portion of the capacitor box 80 so as to correspond to the cells 41 and 41 of the upper and lower stages, respectively. Furthermore, an exhaust duct 39 is connected to the left side (the right side in FIG. 5), and louvers 37 are provided at the downstream end portion in the exhaust duct 39 so as to face the louvers 35.

The louvers 36 corresponding to the air intake side are inclined downward relative to the flow direction of cooling air that flows to the right from the left in FIG. 5, and the louvers 38 provided in the air intake duct 40 on the downstream side of the louvers 36 are inclined upward so as to be opposite to the louvers 36. In addition, the louvers 37 provided in the exhaust duct 39 are inclined downward relative to the flow direction of cooling air, and the louvers 35, which correspond to the exhaust side and are provided on the downstream side of the louvers 37, are inclined upward so as to be opposite to the louvers 37. The capacitor box 80 is intended to be made waterproof by the above-mentioned structure of the louvers.

Further, since the capacitor box 80 is installed on the bottom frame Ba as described above, the position where the capacitor box is installed is lower than the right and left opening portions 34 and 33. For this reason, the air intake duct 40 and the exhaust duct 39 have an asymmetric shape in the vertical direction. That is, the air intake duct 40 and the exhaust duct 39 have a shape that extends downward from both the louvers 38 and 37 toward the capacitor box 80.

Furthermore, a partition wall 44, which connects an upstream end portion formed between the upper-stage module 45 and the lower-stage module 45 to the downstream end portion of the louver 38 and partitions the inner space of the air intake duct 40 into upper and lower spaces, is provided in the air intake duct 40. The partition wall 44 distributes the same amount of cooling air as the amount of cooling air, which is to be supplied to the upper-stage module 45, to the lower-stage module 45 that is disposed so as to be shifted downward without exactly facing the louvers 38 arranged side by side in the vertical direction. The partition wall 44 is inclined downward relative to the flow direction of cooling air without being horizontal so that the flow rate of cooling air at a lower inlet is larger than the rate of cooling air at an upper inlet (an outlet of the louvers 38).

Meanwhile, the capacitor box 80, the air intake duct 40, the exhaust duct 39, the opening portion 34, the opening portion 33, and the like are installed at the right front portion Rf here, but may be installed at the left front portion Lf below the operator's cab 4*a*.

Further, coolers, such as a radiator for an engine, an oil cooler, an intercooler, a fuel cooler, a radiator for a hybrid system (a radiator for hybrid), and a heat exchanger for an air conditioner of the operator's cab 4*a* (a capacitor for an air conditioner) (none of which are shown), are installed in the left rear portion Lr of FIG. 4.

Furthermore, the engine 11, the transmission 13, the electric generator 12, the main pump 14, and the like shown in FIG. 2 are installed from the left rear portion Lr to the right rear portion Rr, that is, below an engine hood H forming a top panel. A fan (not shown) is connected to the engine 11. Accordingly, the fan is rotated by the rotation of the engine 11, so that air flows into the left rear portion Lr from a vent 46 formed at the left side of the left front portion Lf. As a result, the above-mentioned respective coolers installed in the left rear portion Lr are cooled.

So-called A-frames 47 that are frames where the boom 5 is supported and interposed so as to be capable of moving up and down, and a boom cylinder frame 48 that is a frame on which the base end of the boom cylinder 8 is mounted are provided at the central portion C.

Next, a structure related to wires of high voltage cables of the electric generator 12 and the revolving electric motor 21 will be described in detail.

Figure 6:
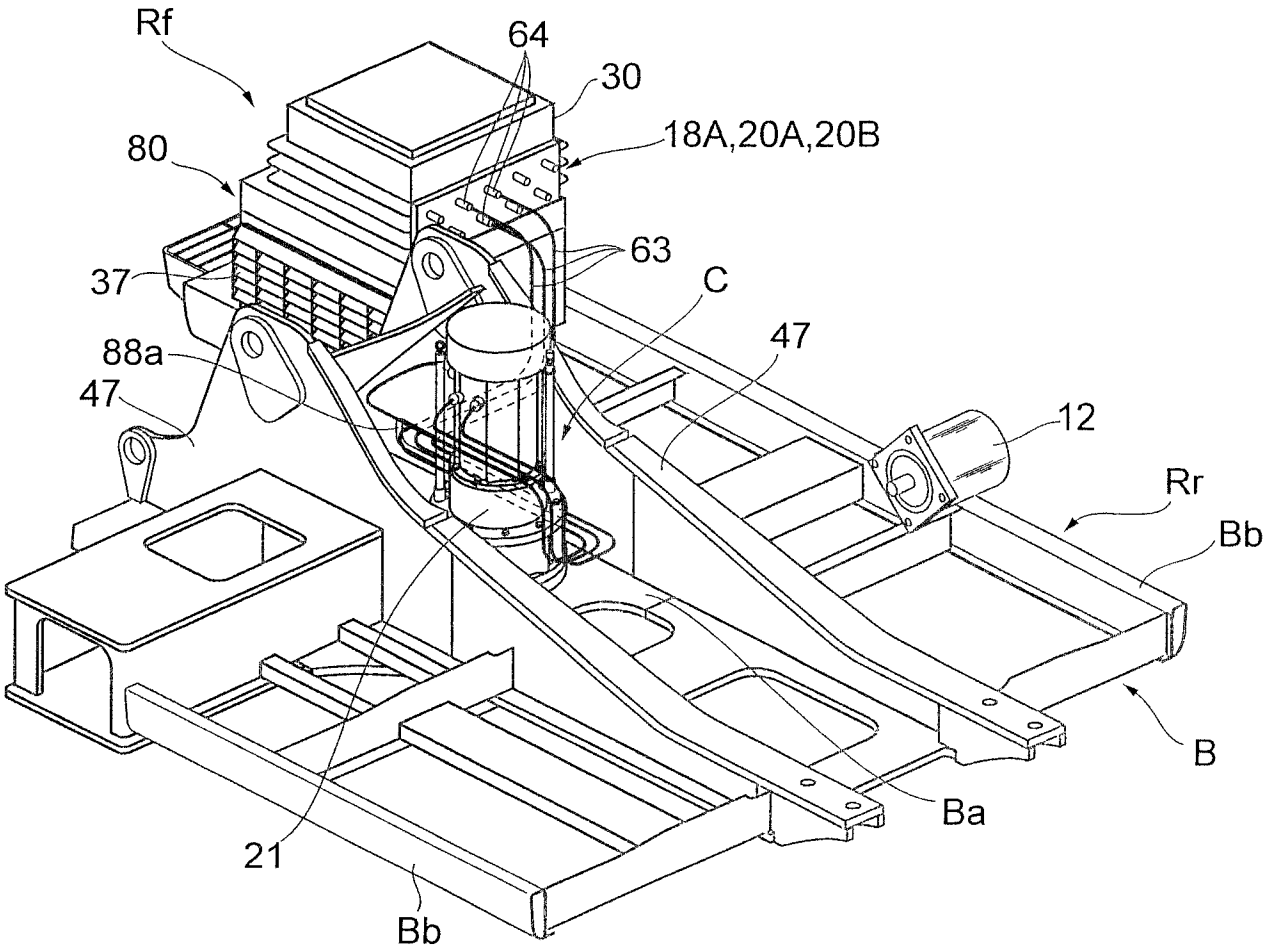
FIG. 6 is a perspective view showing wires of high voltage cables, which connect a revolving electric motor to an inverter circuit thereof, together with a base frame, an A-frame, and components in a right front portion of the house portion, and is a perspective view as seen from the rear upper side of a left portion of a vehicle.
Figure 7:
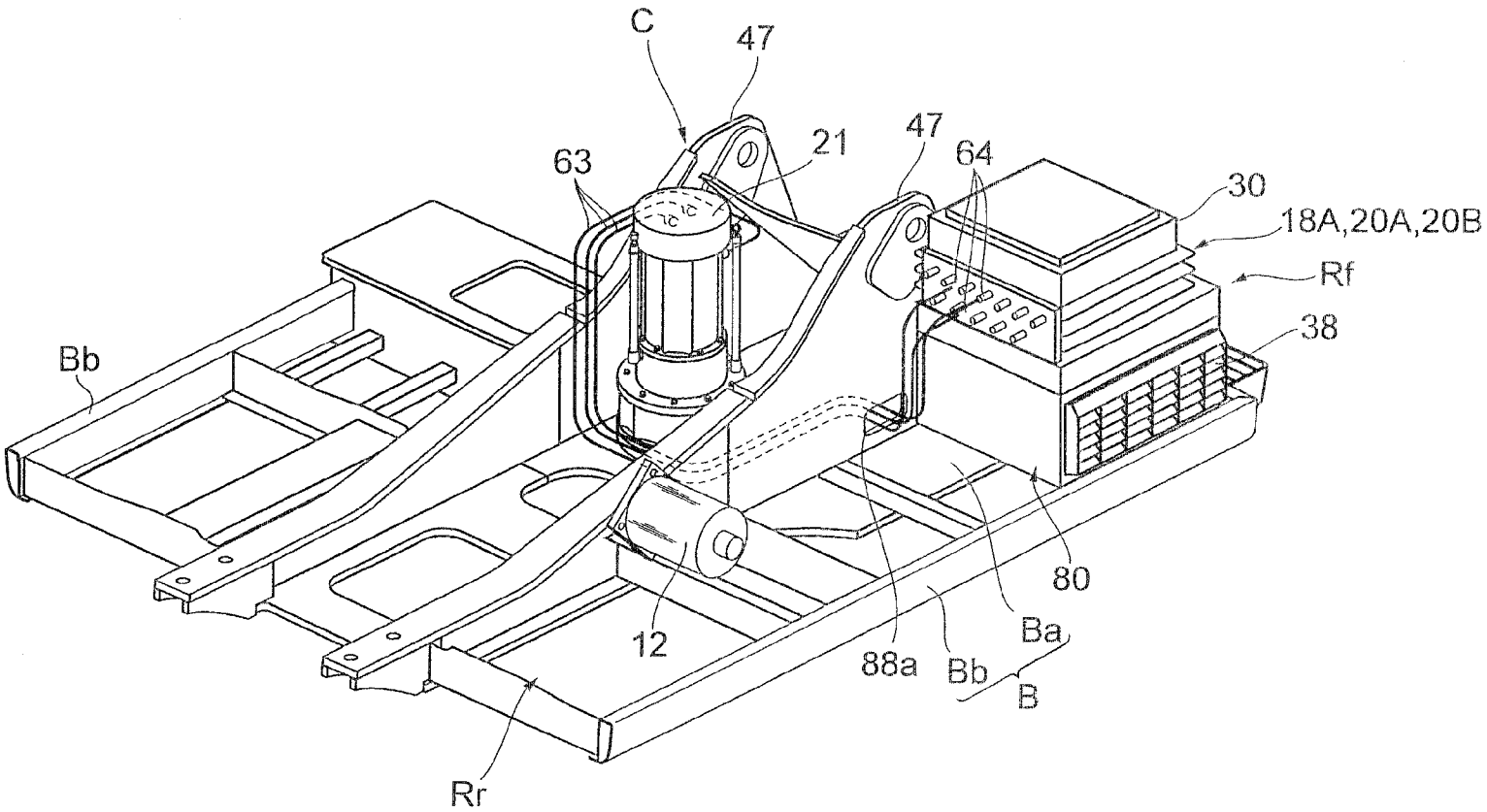
FIG. 7 is a perspective view of FIG. 6 as seen from the rear upper side of a right portion of a vehicle.
Figure 8:
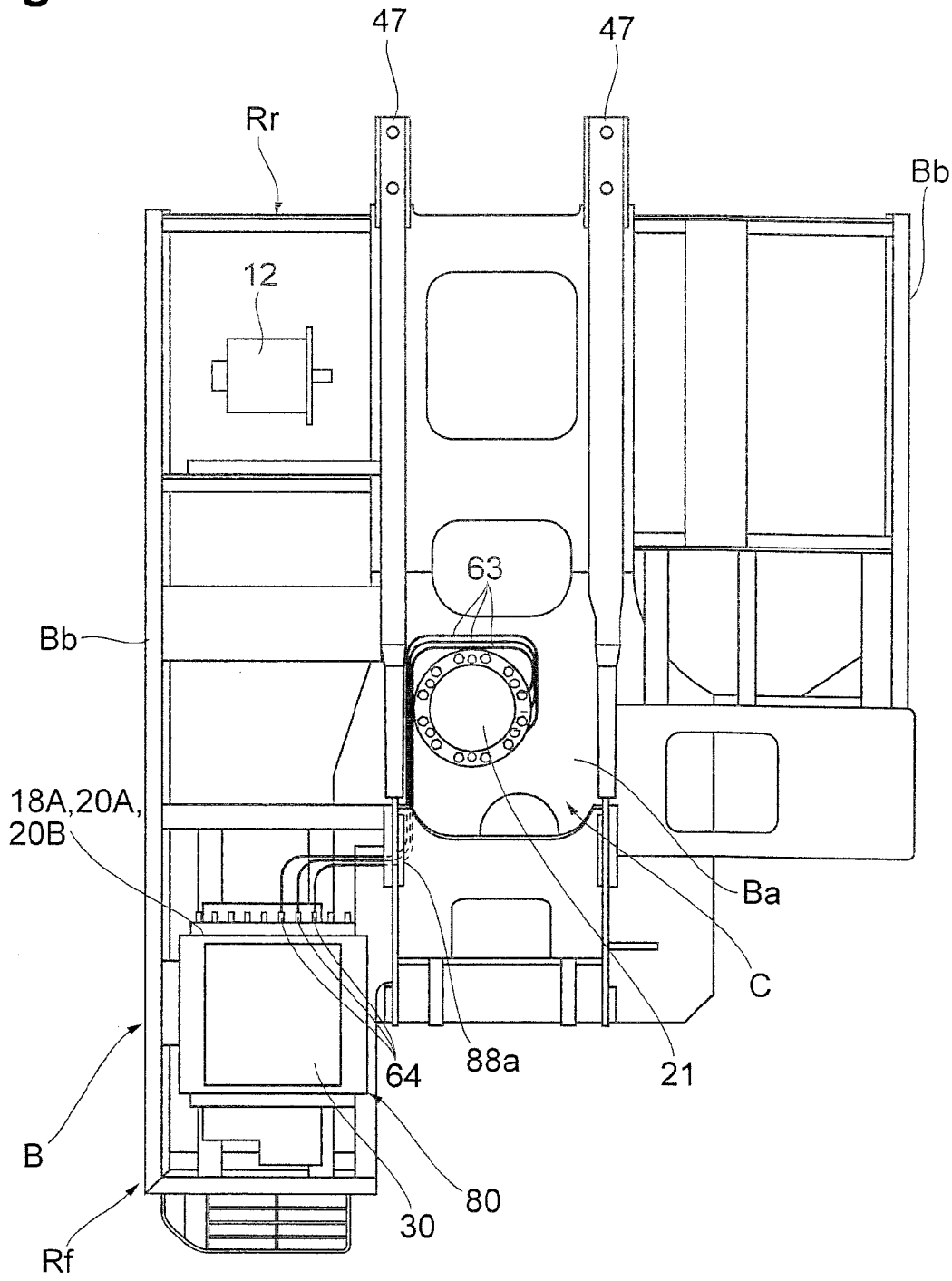
FIG. 8 is a plan view of FIGS. 6 and 7.
Figure 9:
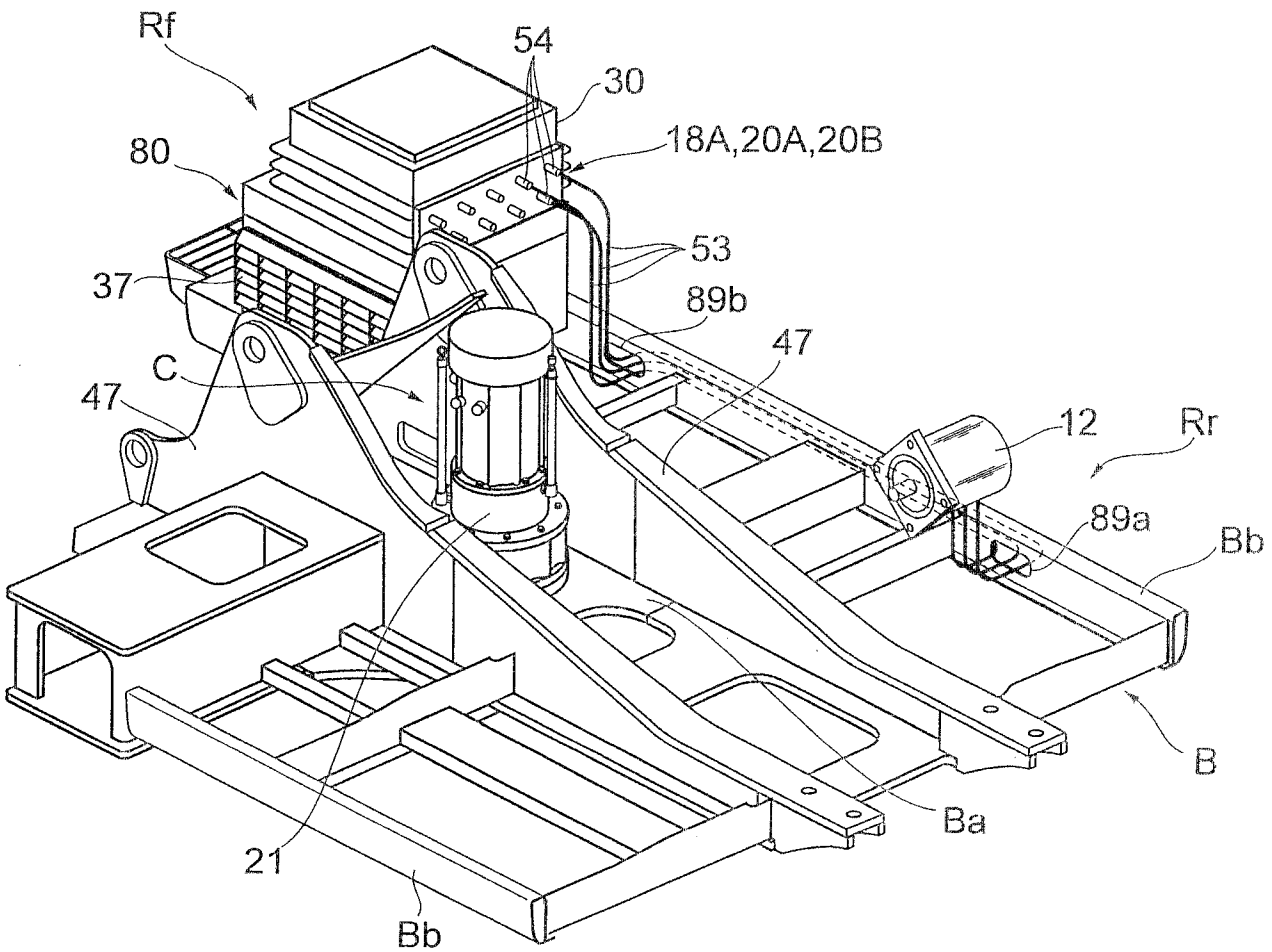
FIG. 9 is a perspective view showing wires of high voltage cables, which connect an electric generator to an inverter circuit thereof, together with a base frame, an A-frame, and components in a right front portion of the house portion, and is a perspective view as seen from the rear upper side of a left portion of a vehicle.
Figure 10:
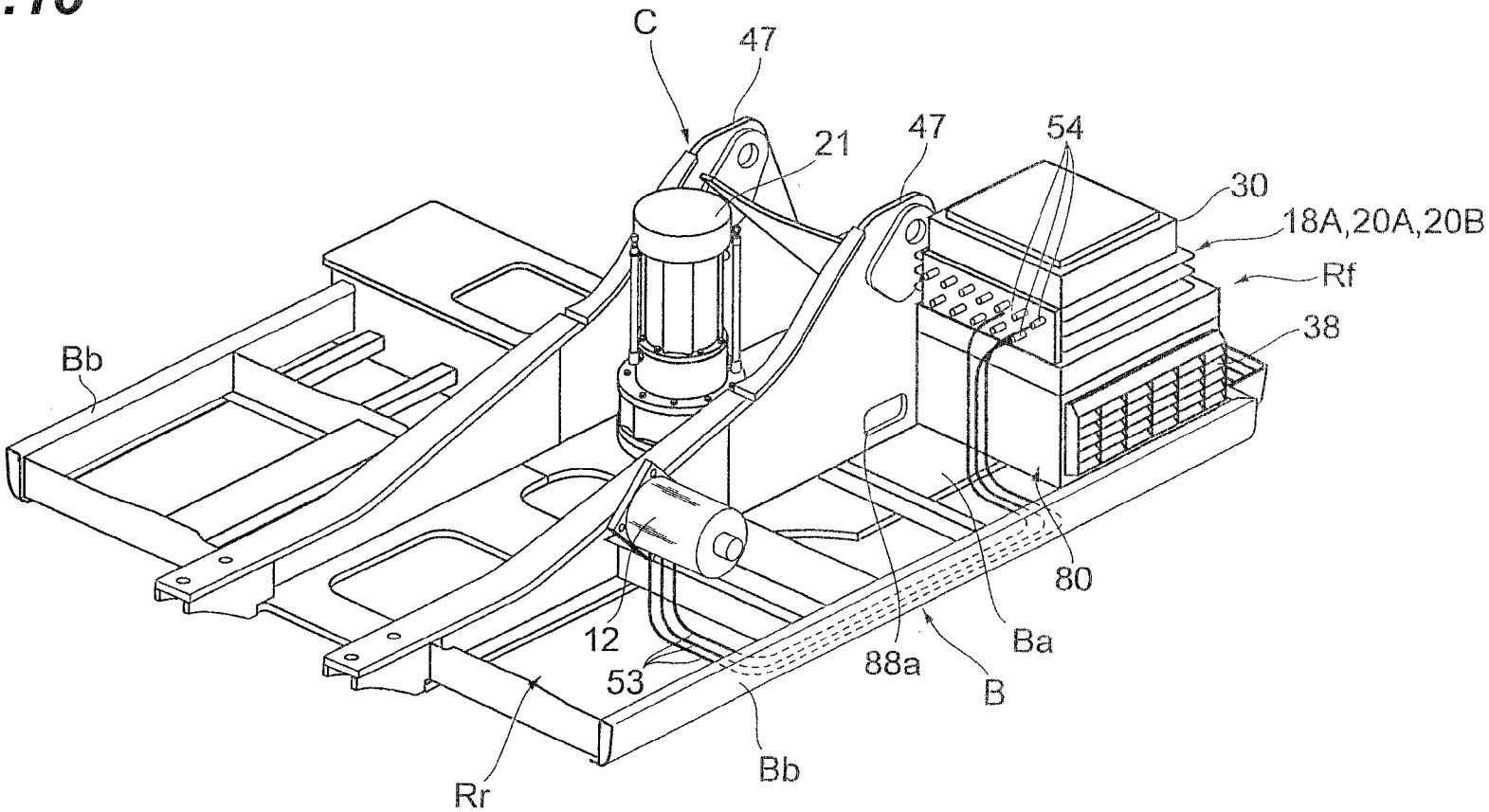
FIG. 10 is a perspective view of FIG. 9 as seen from the rear upper side of a right portion of a vehicle.
Figure 11:
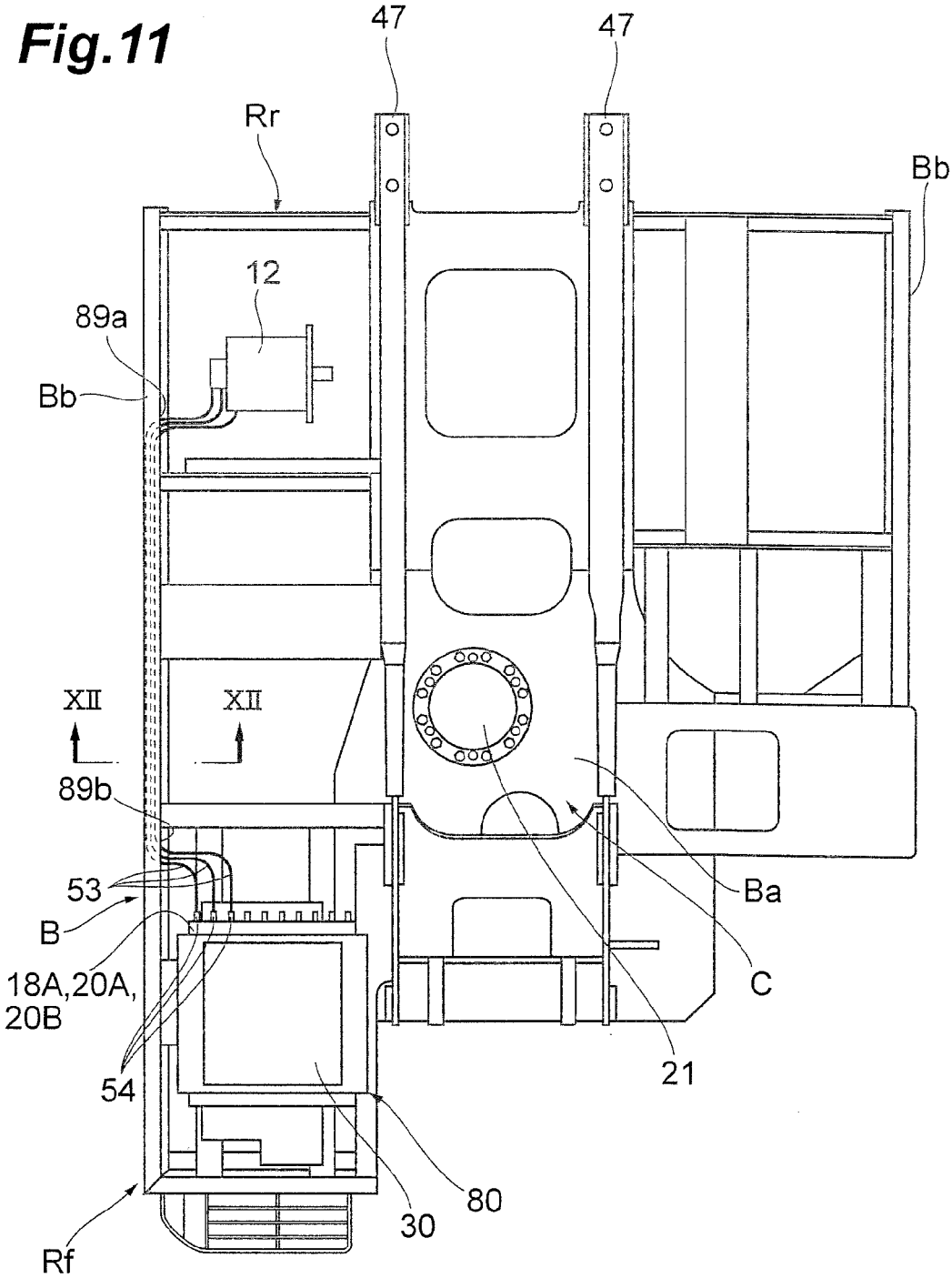
FIG. 11 is a plan view of FIGS. 9 and 10.
Figure 12:
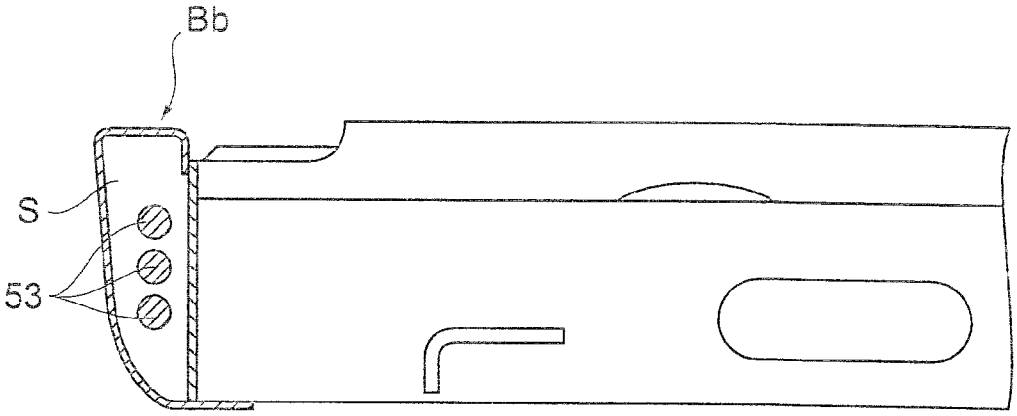
FIG. 12 is a view taken along line XII-XII of FIG. 11.

FIG. 6 is a perspective view showing wires of high voltage cables 63, which connect the revolving electric motor 21 to the inverter circuit 20A thereof, together with the base frame B, the A-frames 47, and components in the right front portion Rf of the house portion, and is a perspective view as seen from the rear upper side of the left portion of the vehicle; FIG. 7 is a perspective view of FIG. 6 as seen from the rear upper side of the right portion of the vehicle; FIG. 8 is a plan view of FIGS. 6 and 7; FIG. 9 is a perspective view showing wires of high voltage cables 53, which connect the electric generator 12 to the inverter circuit 18A thereof, together with the base frame B, the A-frames 47, and components in the right front portion Rf of the house portion, and is a perspective view as seen from the rear upper side of the left portion of the vehicle; FIG. 10 is a perspective view of FIG. 9 as seen from the rear upper side of the right portion of the vehicle; FIG. 11 is a plan view of FIGS. 9 and 10; and FIG. 12 is a view taken along line XII-XII of FIG. 11.

As shown in FIGS. 6 and 7, the capacitor box 80 to which the air intake duct 40 and the exhaust duct 39 are connected, the inverter circuits 18A, 20A, and 20B, and the controller 30 are mounted on the bottom frame Ba in the right front portion Rf of the house portion from the lower side to the upper side.

Further, a pump chamber (not shown) is formed in the house portion 4*b* on the base frame B at the right rear portion Rr and the transmission 13, the electric generator 12, and the main pump 14 are provided in the pump chamber.

Furthermore, the A-frames (frame structural members) 47 and 47, which support the boom 5, are formed at the central portion C so as to protrude in the vertical direction and face each other, and the revolving electric motor 21 is provided near the rear portion of the boom 5 at the middle position interposed between the A-frames 47 and 47 so as to be substantially erected on the bottom frame Ba.

Moreover, outer peripheral frames (side frames; frame structural members) Bb forming the base frame B are provided at both left and right end portions of the base frame B so as to extend in a longitudinal direction. As shown in FIG. 12, the outer peripheral frame Bb is formed in the shape of a rectangular tube that extends in the vertical direction, and a closed cross-sectional space S having a substantially rectangular cross-section is formed in the outer peripheral frame Bb.

Here, as shown in FIGS. 6 to 8, the high voltage cables 63, which connect the revolving electric motor 21 to the inverter circuit 20A thereof and through which power is supplied, are wired along the inner side surface of the A-frame 47.

Specifically, an opening 88*a* through which the high voltage cables 63 corresponding to three phases (U, V, and W) pass is formed at the lower portion of the A-frame 47 facing the capacitor box 80 at a position close to the capacitor box 80. The high voltage cables 63 extending from the revolving electric motor 21 are laid along the inner surface of the lower portion of the A-frame 47 that protrudes in the vertical direction on the side close to the capacitor box 80, are led to the outside of the A-frame 47 through the opening 88*a*, and are connected to three-phase terminals 64 of the inverter circuit 20A, respectively.

Further, as shown in FIGS. 9 to 12, the high voltage cables 53, which connect the electric generator 12 to the inverter circuit 18A thereof and through which power is supplied, are wired so as to pass through the outer peripheral frame Bb.

Specifically, openings 89*a* and 89*b* through which the high voltage cables 53 corresponding to three phases (U, V, and W) pass are formed at the outer peripheral frame Bb, which faces the electric generator 12 and the capacitor box 80, at a position corresponding to the side of the electric generator 12 and a position close to the capacitor box 80, respectively. The high voltage cables 53 extending from the electric generator 12 are introduced into the outer peripheral frame Bb through the opening 89*a*, pass through the closed cross-sectional space S formed in the outer peripheral frame, are laid along the side surfaces of inner and outer walls of the outer peripheral frame Bb protruding in the vertical direction, are led to the outside of the outer peripheral frame Bb through the opening 89*b*, and are connected to three-phase terminals 54 of the inverter circuit 18A, respectively.

Since the high voltage cables 53 and 63 are wired along the side surfaces of the frame structural members Bb and 47 protruding in the vertical direction in this embodiment as described above, the frame structural members Bb and 47 become upright walls, so that the high voltage cables 53 and 63 are adequately protected. Accordingly, for example, even when the lifting magnet vehicle 1 collides with an obstruction or the like, the high voltage cables 53 and 63 are adequately protected by the frame structural members Bb and 47. As a result, safety is improved.

Further, since the high voltage cables 63 forming the frame structural member are wired along the inner side surface of the A-frame 47, the high voltage cables 63 are adequately protected by the A-frame 47 having high rigidity. Accordingly, safety is improved. In addition, even when the lifting magnet vehicle 1 collides with an obstruction or the like, the A-frame 47 is separated from a collision portion since being disposed at the central portion. Accordingly, the high voltage cables 63 are more adequately protected.

Moreover, since the high voltage cables 53 forming the frame structural member pass through the outer peripheral frame Bb that has high rigidity and forms a closed cross-section, the high voltage cables 53 are adequately protected, so that safety is improved. Further, the outer peripheral frame Bb surrounding the high voltage cables 53 is made of metal, so that the outer peripheral frame Bb blocks electromagnetic waves. Accordingly, electromagnetic shielding performance is also improved.

In addition, the high voltage cables 53 and 63 can be wired separately from a control harness having a low voltage (for example, 24 V) connected to the controller 30 or the like, it is possible to reduce noise that is generated on the harness by the high voltage cables 53 and 63.

Meanwhile, a waterproof cap (not shown) is provided at portions of the high voltage cables 63 penetrating a frame of the revolving electric motor 21 and a waterproof cap (not shown) is provided at portions of the high voltage cables 53 penetrating a frame of the electric generator 12 so that the frames are sufficiently intended to be made waterproof. For example, a waterproof cap, which is made of a fluororesin and has heat resistance, may be used as these waterproof caps.

Figure 13:
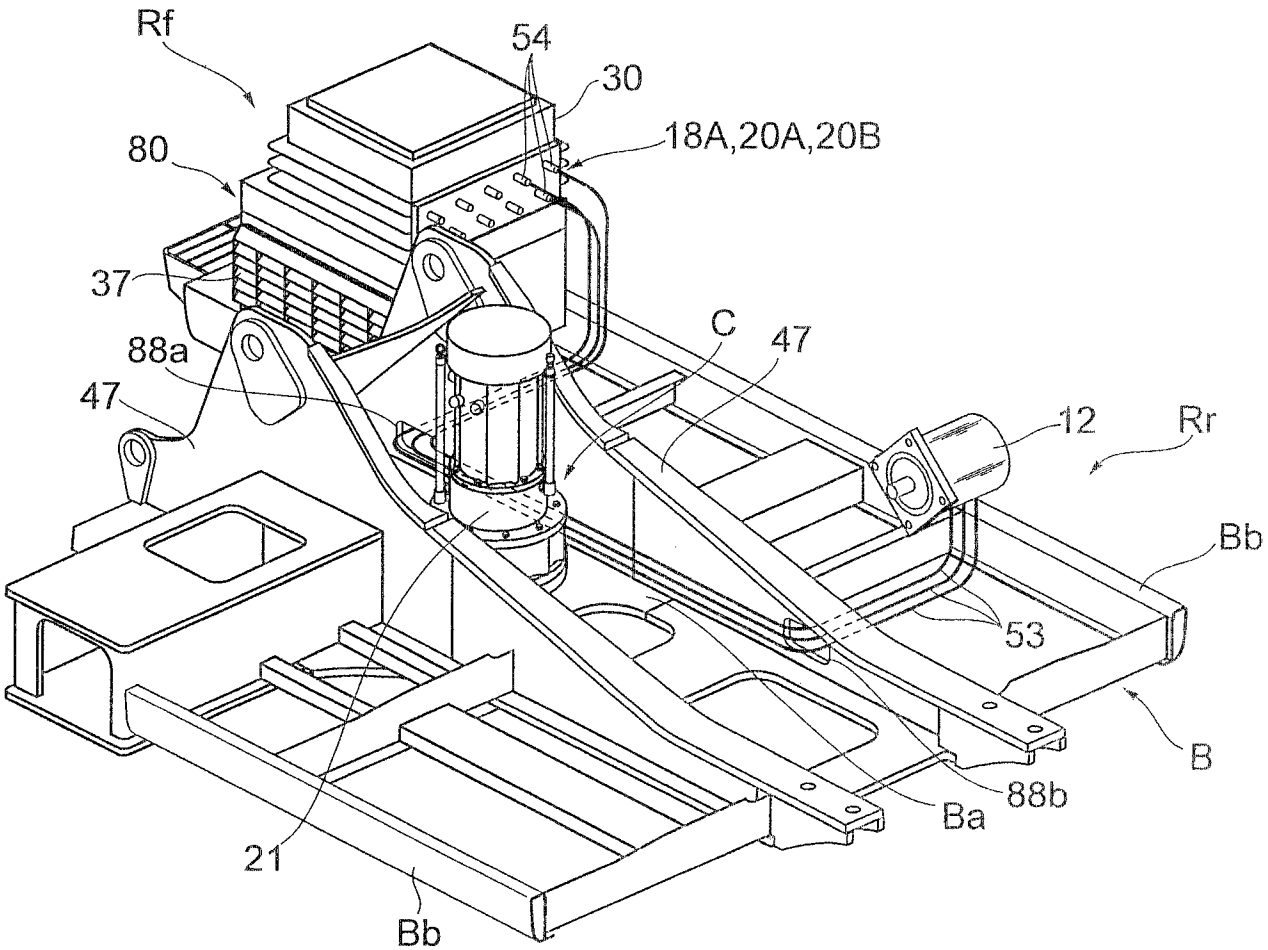
FIG. 13 is a perspective view showing main portions of a construction machine according to a second embodiment of the invention, is a perspective view showing wires of high voltage cables, which connect an electric generator to an inverter circuit thereof, together with a base frame, A-frames, and components in a right front portion of a house portion, and is a perspective view as seen from the rear upper side of a left portion of a vehicle.
Figure 14:
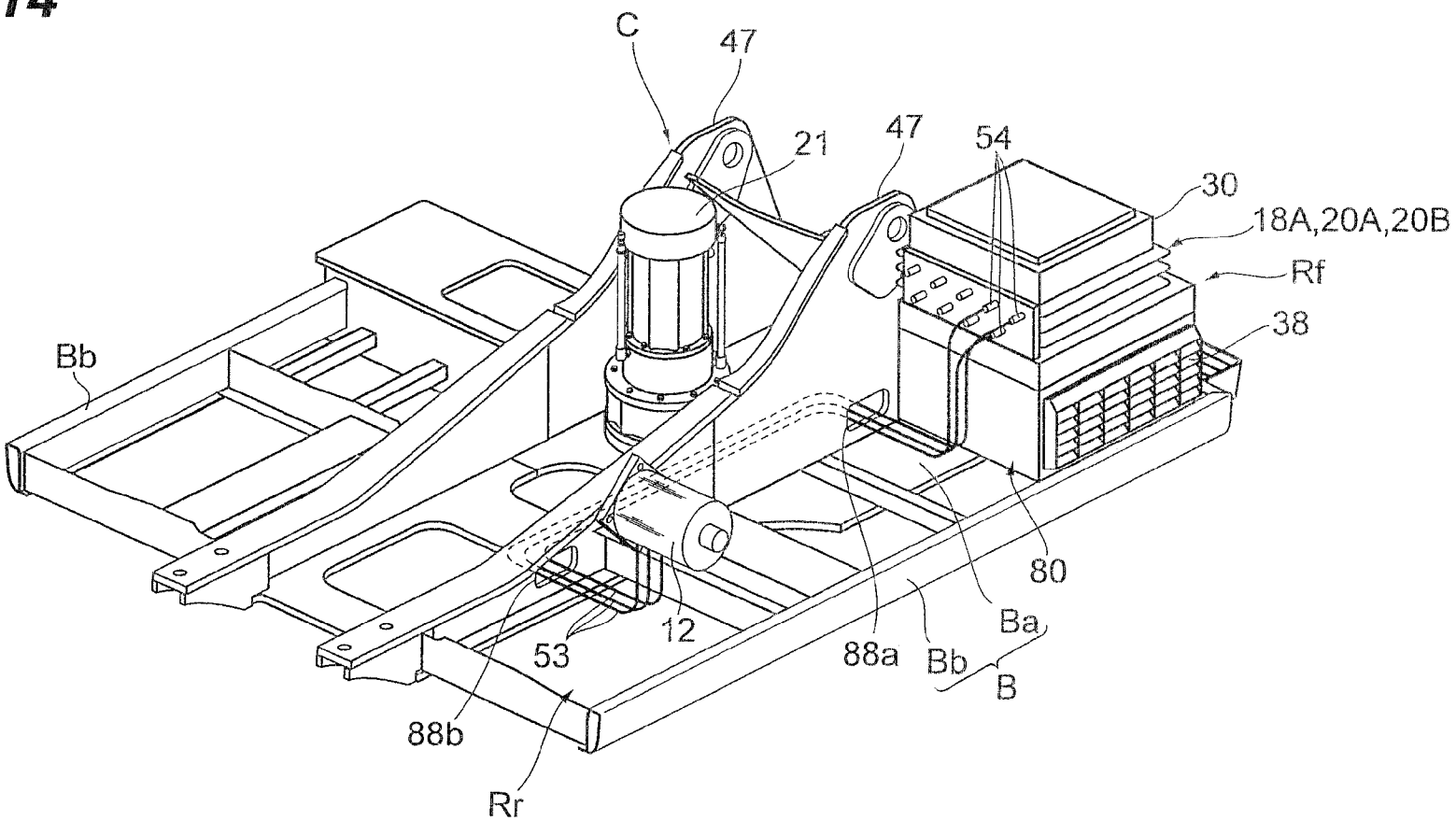
FIG. 14 is a perspective view of FIG. 13 as seen from the rear upper side of a right portion of a vehicle.
Figure 15:
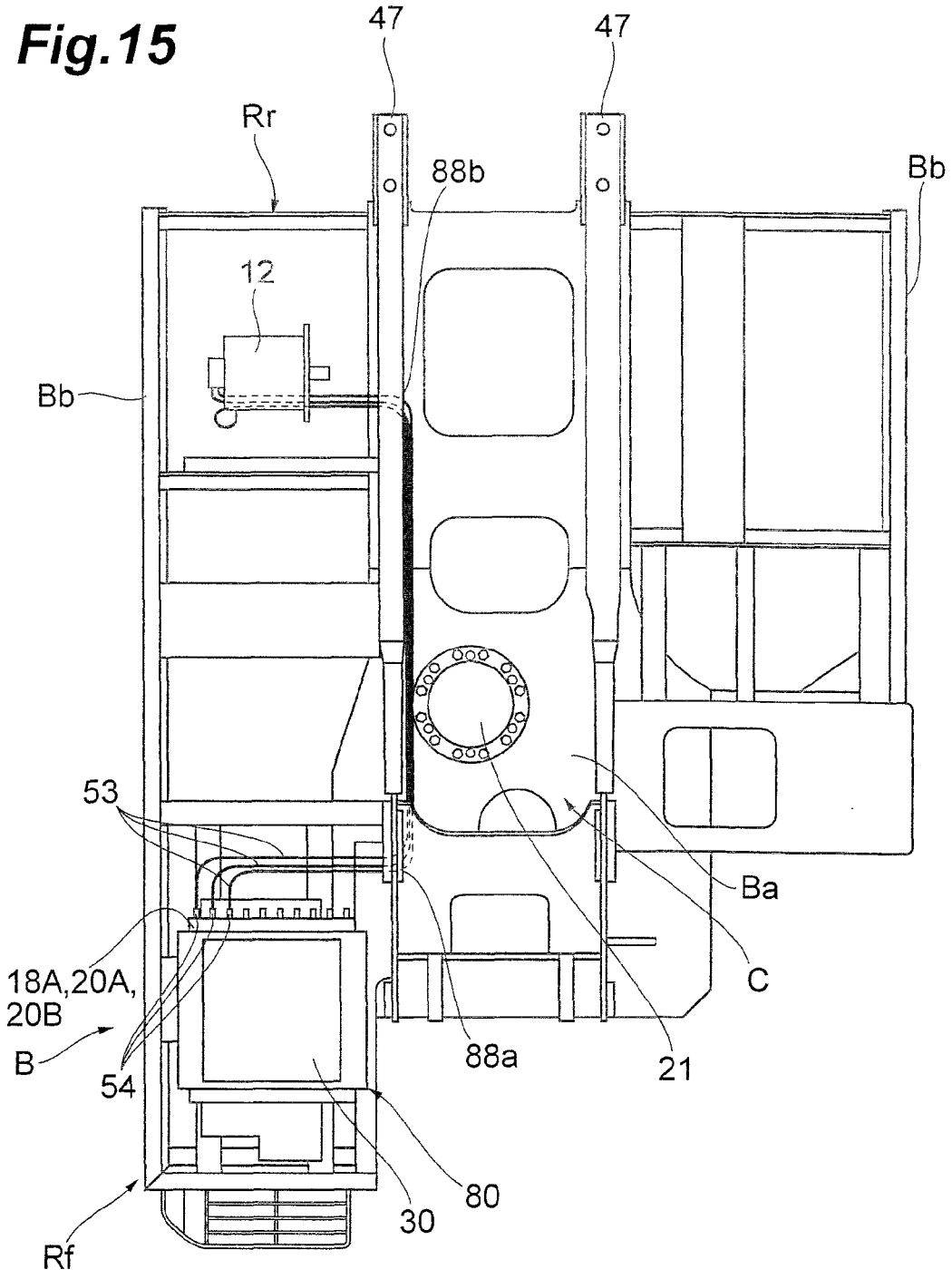
FIG. 15 is a plan view of FIGS. 13 and 14.

FIG. 13 is a perspective view showing main portions of a construction machine according to a second embodiment of the invention; is a perspective view showing wires of high voltage cables 53, which connect an electric generator 12 to an inverter circuit 18A thereof, together with a base frame B, A-frames 47, and components in a right front portion Rf of a house portion; and is a perspective view as seen from the rear upper side of a left portion of a vehicle. FIG. 14 is a perspective view of FIG. 13 as seen from the rear upper side of a right portion of a vehicle, and FIG. 15 is a plan view of FIGS. 13 and 14.

This second embodiment is different from the first embodiment in that the wires of high voltage cables 53 are wired along the inner side surface of the A-frame 47.

Specifically, an opening 88*b* through which the high voltage cables 53 pass is formed at the lower portion of the A-frame 47 facing the electric generator 12 at a position corresponding to the side of the electric generator 12. The high voltage cables 53 extending from the electric generator 12 are led to the inside of the A-frame 47 facing the electric generator 12 through the opening 88*b*, are laid along the inner surface of the lower portion of the A-frame 47, are led to the outside of the A-frame 47 through the above-mentioned opening 88*a*, and are connected to terminals 54 of the inverter circuit 18A, respectively.

It goes without saying that the same operation and effect as the operation and effect of the high voltage cables 63 described in the first embodiment are obtained even in this second embodiment.

Meanwhile, although not described here, high voltage cables 63, which connect a revolving electric motor 21 to an inverter circuit 20A, may be wired so as to pass through an outer peripheral frame Bb.

Further, in the above-mentioned first and second embodiments, the high voltage cables 53 between the electric generator 12 and the inverter circuit 18A thereof or the high voltage cables 63 between the revolving electric motor 21 and the inverter circuit 20A thereof are wired along the inner side surface of the A-frame 47 or are wired so as to pass through the outer peripheral frame Bb. However, in the cases of an electric generator with an inverter and a revolving electric motor with an inverter that are obtained by attaching the inverter circuits 18A and 20A to the electric generator 12 and the revolving electric motor 21, respectively, high voltage cables connecting the inverter circuit 18A to the storage means 120 and high voltage cables connecting the inverter circuit 20A to the storage means 120 are wired along the inner side surface of the A-frame 47 or are wired so as to pass through the outer peripheral frame Bb.

Figure 16:
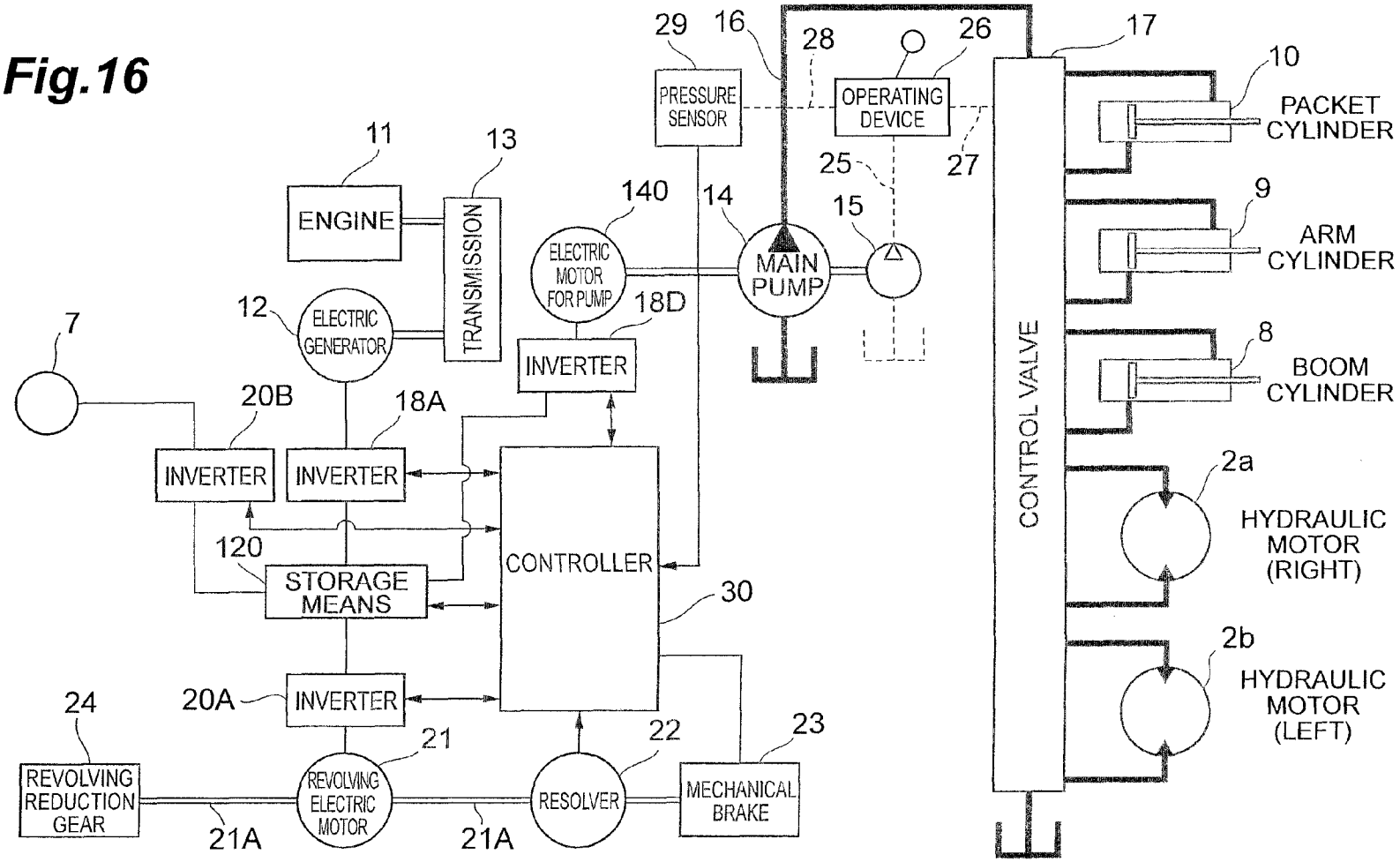
FIG. 16 is a block diagram showing the internal structure of an electrical system, a hydraulic system, and the like of a construction machine according to another embodiment.

FIG. 16 is a block diagram showing the internal structure of an electrical system, a hydraulic system, and the like of a construction machine according to another embodiment.

A structure shown in FIG. 16 is a so-called series type, is separately provided with an electric motor 140 for a pump and an inverter 18D instead of the structure, which connects the transmission 13 to the main pump 14, in the parallel type structure shown in FIG. 2; converts the entire power of the engine 11 into electrical energy once; and drives various drive elements.

Specifically, the inverter 18D is electrically connected to the DC bus 110 (see FIG. 3) of the storage means 120 and is controlled by the controller 30. Further, an output end of the inverter 18D is connected to the electric motor 140 for a pump, and the electric motor 140 for a pump is driven and controlled by the inverter 18D. Furthermore, power, which is generated by the main pump 14 in the electric motor 140 for a pump, is supplied to the storage means 120 through the inverter 18D as regenerated energy.

The invention has been specifically described above with reference to the embodiments thereof, but the invention is not limited to the above-mentioned embodiments. For example, in the above-mentioned embodiments, the invention has been applied to a lifting magnet type hybrid construction machine as a particularly preferred example. However, the invention may be applied to other construction machines such as a shovel, a wheel loader, or a crane.

INDUSTRIAL APPLICABILITY

According to the invention, it is possible to improve the safety of wires in a construction machine.

REFERENCE SIGNS LIST

1: lifting magnet vehicle (construction machine)
5: boom
11: engine
12: electric generator (power generation means)
18A, 20A: inverter
21: revolving electric motor (electric drive means)
47: A-frame (frame structural member)
53, 63: high voltage cable
120: storage means
B: base frame
Bb: outer peripheral frame (side frame; frame structural member)
S: closed cross-sectional space

The invention claimed is:

1. A construction machine comprising:
a traveling mechanism;
a revolving body mounted on the traveling mechanism;
an engine;
a power generator generating power by drive of the engine;
a storage device storing power generated by the power generator via an inverter; and
high voltage cables connecting the power generator and the inverter,
wherein the revolving body includes a base frame and an A-frame supporting a boom,
the A-frame protrudes from the base frame in a vertical direction and extends from a front center portion to a rear center portion of the base frame,
the inverter and the storage device are positioned at a right front portion of the base frame,
the power generator is positioned at a right rear portion of the base frame, and
the high voltage cables extend from the power generator positioned at the right rear portion of the base frame toward the A-frame, further extend toward a front portion of the base frame along a substantial length of the A-frame, and are further connected to the inverter positioned at the right front portion of the base frame.

2. A construction machine comprising:
a traveling mechanism;
a revolving body mounted on the traveling mechanism;
a revolving electric motor driving the revolving body;
a storage device supplying power stored therein to the revolving electric motor via an inverter; and
high voltage cables connecting the revolving electric motor and the inverter, wherein the revolving body includes a base frame and an A-frame supporting a boom,
the A-frame protrudes from the base frame in a vertical direction and extends from a front center portion to a rear center portion of the base frame,
the inverter and the storage device are positioned at the right front portion of the base frame,
the revolving electric motor is positioned at a center portion of the base frame, and
the high voltage cables extend from the inverter positioned at the right front portion of the base frame toward the A-frame, further extend toward a rear portion of the base frame along a substantial length of the A-frame, and are further connected to the revolving electric motor positioned at the center portion of the base frame.

* * * * *